US005407417A

United States Patent [19]

Goldstein

[11] Patent Number: 5,407,417

[45] Date of Patent: Apr. 18, 1995

[54] RIBBON CURLING DEVICE

[76] Inventor: Fredric Goldstein, Liljekungsvagen 186, Vallingby, Sweden, S-162 42

[21] Appl. No.: 938,213

[22] PCT Filed: Apr. 10, 1991

[86] PCT No.: PCT/EP91/00690

§ 371 Date: Oct. 26, 1992

§ 102(e) Date: Oct. 26, 1992

[87] PCT Pub. No.: WO91/16178

PCT Pub. Date: Oct. 31, 1991

[30] Foreign Application Priority Data

Apr. 12, 1990 [GB] United Kingdom ..... 9008342

[51] Int. Cl.[6] ..... B31F 1/14; B31F 1/00; B65H 23/10; B65H 16/00

[52] U.S. Cl. ..... 493/459; 493/460; 493/462; 162/271

[58] Field of Search ..... 493/459, 460, 462; 162/197, 270, 271

[56] References Cited

U.S. PATENT DOCUMENTS

| | | | |
|---|---|---|---|
| 754,797 | 3/1904 | Ostrander | 162/271 |
| 1,150,608 | 8/1915 | Lundeberg | 162/271 |
| 3,263,883 | 8/1966 | Waltz | 225/36 |
| 3,552,668 | 1/1971 | Kanno | 162/271 |
| 3,962,957 | 6/1976 | Hinzmann | 162/271 |
| 4,339,855 | 7/1982 | Demiere | 162/271 |
| 4,952,281 | 8/1990 | Akira | 493/459 |
| 5,013,291 | 5/1991 | Granger | 493/439 |

FOREIGN PATENT DOCUMENTS

| | | | |
|---|---|---|---|
| 747107 | 11/1966 | Canada | 493/459 |
| 368764 | 5/1990 | European Pat. Off. . | |
| 3833804 | 6/1989 | Germany | 162/271 |
| 2221871 | 2/1990 | United Kingdom . | |

*Primary Examiner*—William E. Terrell
*Attorney, Agent, or Firm*—Lerner, David, Littenberg, Krumholz & Mentlik

[57] ABSTRACT

A ribbon curling device to facilitate the curling of a length of decorative ribbon such as gift wrapping ribbon includes a housing for storing the ribbon, a curling edge associated with an exit aperture in a wall of the housing, and a guide spaced from the curling edge to guide the ribbon to the curling edge and determine the approach angle of the ribbon to the curling edge to facilitate the curling of the ribbon as it is drawn along the curling edge. The guide is further provided with an integral drag surface for imparting a frictional drag on a portion of the ribbon as it is drawn along the guide. The ribbon curling device includes several alternative mechanisms for varying the approach angle of the ribbon to the curling edge to thereby vary the amount of curl to the ribbon, including a variable length guide edge, a ribbon guide movable with respect to the curling edge, and a rotatable guide cam having a number of guide faces.

11 Claims, 5 Drawing Sheets

RIBBON CURLING DEVICE

The present invention relates to a ribbon curling device, particularly for curling the ends of gift wrapping ribbon.

Gift wrapping ribbon is typically made of polypropylene and has the property that it curls up if tension or shear forces are applied to one side of the ribbon only. This characteristic can be used to produce pleasing decorative effects, such as ringlets, on the ends of ribbon used to tie up a gift package.

One method of forming ringlets is to pull the ribbon over a blade; usually the thumb holds the ribbon against the blade and there is a consequent danger of the user cutting his hand.

My published U.K. Patent Application 2221871 discloses a ribbon curling tool which comprises relatively movable arms respectively having a blade and pad between which the ribbon can be squeezed prior to being pulled therethrough. This device avoids the danger of the user cutting his thumb but requires two handed operation.

It is an object of the present invention to provide an improved ribbon curling device which may also incorporate a ribbon dispenser.

According to the invention there is provided a ribbon curling device having a curling edge and ribbon guide means spaced from the curling edge, in use the guide means controlling the approach angle of ribbon to said edge.

The guide means and curling edge may be fixed relative to one another. Alternatively one of the guide means and curling edge may be movable relative to the other to vary the ribbon approach angle.

The device may be incorporated in a dispenser for use with a source of ribbon.

The device may further include means for controlling the exit angle of ribbon from said edge. In a preferred embodiment a dispenser includes upstanding walls adjacent the ribbon exit aperture of said dispenser. Preferably the curling edge is in the wall of such a dispenser immediately adjacent the ribbon exist aperture; the curling edge may comprise a blade forming one edge of said aperture.

The device may further include drag means for providing resistance to ribbon passage across said curling edge. In one embodiment said drag means comprises a curved surface, the drag force being insufficient to impart a curling effect to the ribbon.

A preferred embodiment includes movable guide means in the form of a cam spaced from the curling edge and having a plurality of guide faces each capable of imparting a different approach angle to the ribbon. Rotation of the cam results in a different ribbon approach angle.

In one position the movable guide means may allow ribbon to be pulled past the blade without contact therewith, thus permitting uncurled ribbon to be drawn from the supply.

When incorporated in a dispenser the device may be bench mounted or hand held.

Other features of the invention will be apparent from the following description of a preferred embodiment shown by way of example only in the accompanying drawings in which:

FIG. 1 is a transverse section through a ribbon dispenser incorporating the invention;

FIG. 1*a* is an enlargement of part of FIG. 1 showing an alternative feature;

Figure 5:
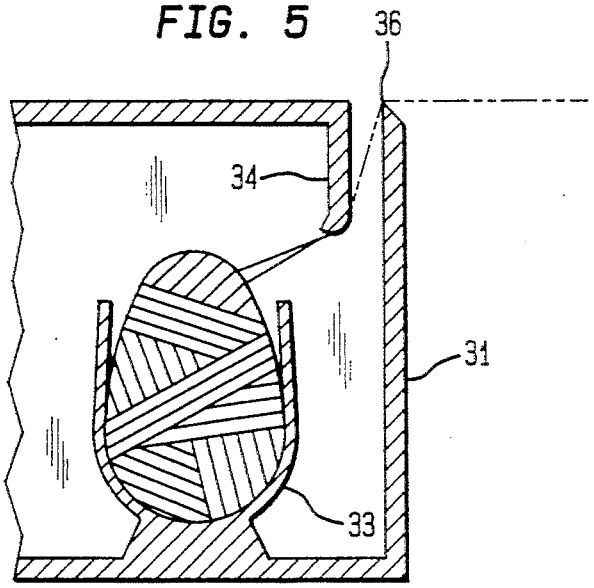
FIG. 5 is a partial transverse section through another alternative ribbon dispenser incorporating the invention.
Figure 6:
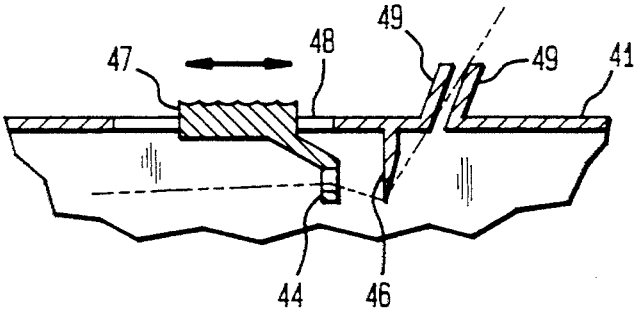
Figure 7:
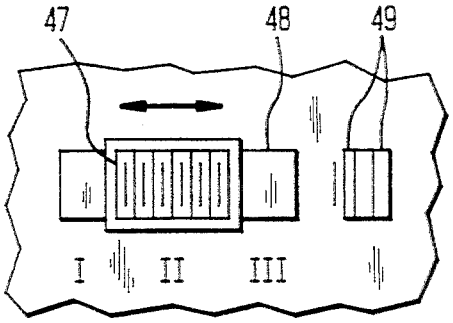
Figure 8:
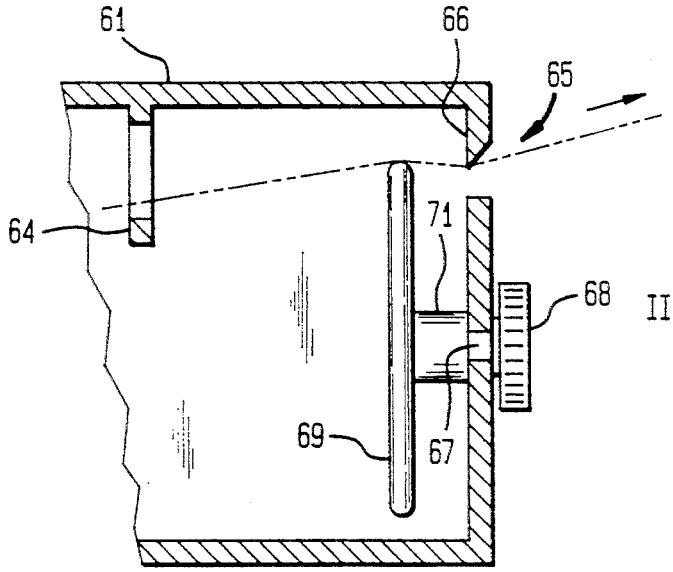
Figure 9:
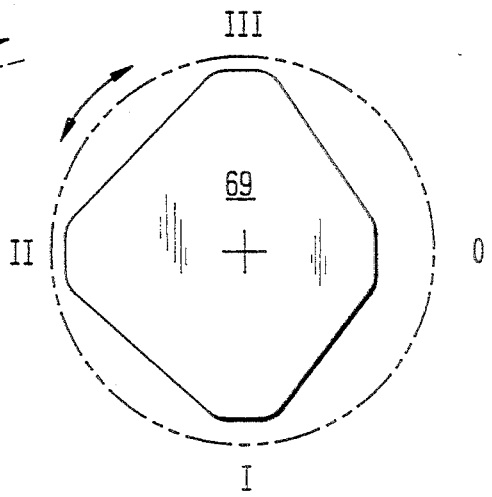
Figure 10:
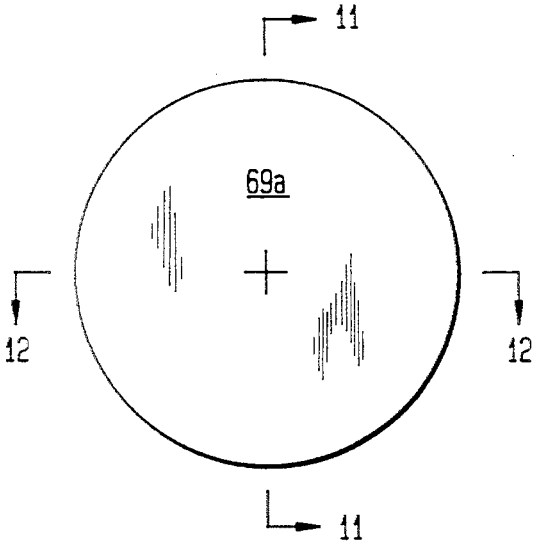
Figure 11:
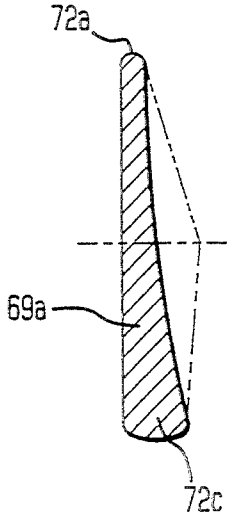
Figure 12:
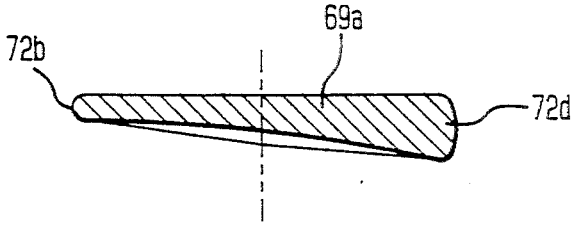
Figure 14:
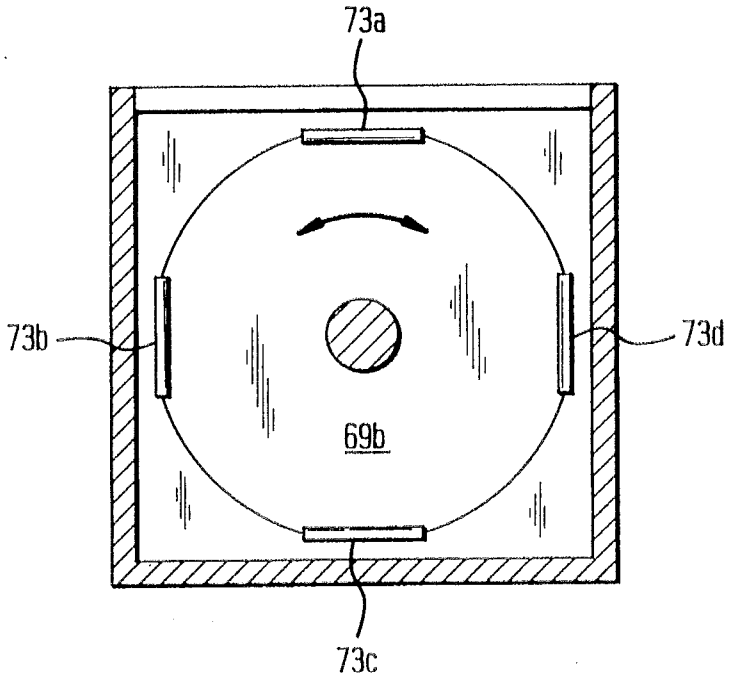
Figure 13:
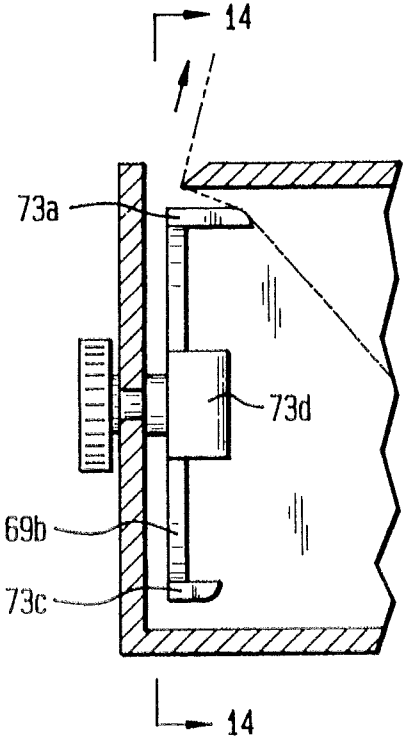

FIGS. 5*a*–5*g* illustrate various ribbon guide arrangements suitable for use with the dispenser of FIG. 5;

FIG. 6 is a partial transverse section through a dispenser/incorporating yet another embodiment of the invention;

FIG. 7 is a partial plan view of the dispenser of FIG. 6;

FIG. 8 is a partial transverse section through a dispenser incorporating yet another embodiment of the invention;

FIG. 9 is a schematic illustration of a cam plate incorporated in the dispenser of FIG. 8;

FIGS. 10–12 show an alternative cam plate for the dispenser of FIG. 8;

FIG. 13 is partial transverse section similar to FIG. 8 and showing yet another cam plate; and FIG. 14 is a section on line 14–14 of FIG. 13.

All dimensions and angles shown in the accompanying drawings are for illustration only; some dimensions and angles have been exaggerated to clearly demonstrate a constructional feature and for clarity.

Figure 1:
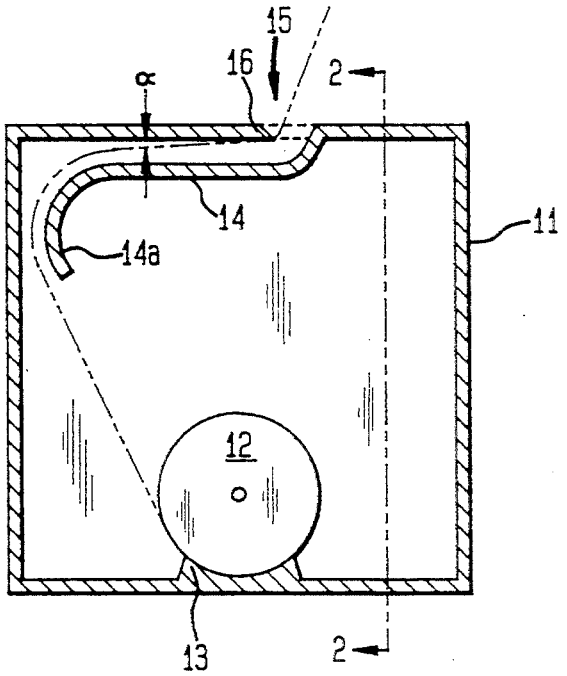
Figure 2:
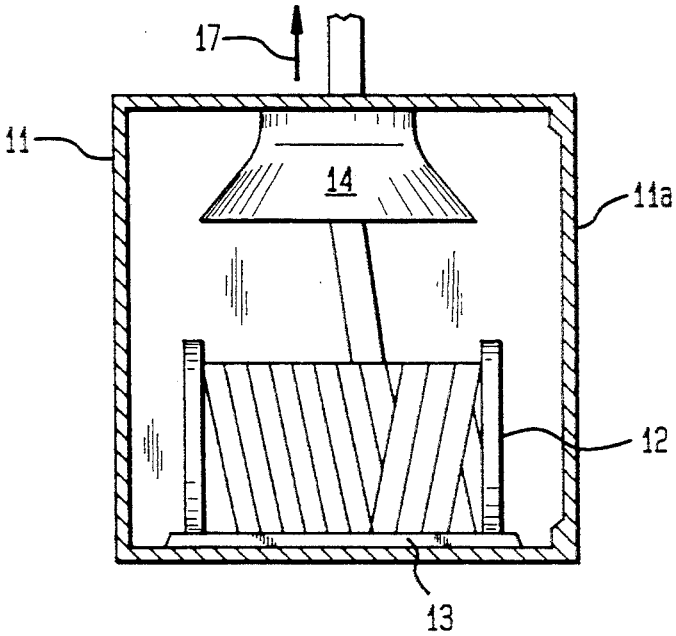
FIG. 2 is a transverse section on line 2—2 of FIG. 1.

With reference to FIGS. 1 and 2, a ribbon dispenser and curler comprises a plastics box 11 having a reel 12 of polypropylene ribbon mounted therein for rotation. In the illustration the reel 12 lays on a curved carriage 13 integrally moulded in the base of the box; the reel could alternatively be mounted on a spindle.

The free end of the ribbon (illustrated by the chain-dot line) passes over a guide 14 and through an outlet aperture 15; the guiding edge of the aperture comprises a curling blade One end 14*a* of the guide is formed as a smooth curve, the shape of the curve being chosen to support the ribbon without unduly stressing the adjacent surface thereof. The end 14*a* also imposes a drag force on the ribbon which facilitates use of the dispenser and prevents the ribbon passing too freely over the curling blade 16. The drag force is determined by the shape and length of the contact surface and may be chosen to suite the width, thickness and material of the ribbon. One wall 11*a* of the dispenser may be removable to facilitate replacement of the ribbon reel.

In use the ribbon is drawn out of the dispenser in the direction of arrow 17. The guide 14 ensures a constant angle of approach $\alpha$ of the ribbon with respect of the curling blade edge. The angle of departure of the ribbon from the dispenser determines the degree of curl imparted by the curling blade; a large included angle (as illustrated) results in a loose curl, whereas an acute angle results in a tight curl. The operator may pull the ribbon at a particularly angle within the range permitted by the aperture 15 to obtain a desired curling effect.

The edge of the aperture opposite the curling blade may be relieved so that ribbon may be drawn from the dispenser without contacting the blade; such an arrangement is further described below.

Figure 1A:
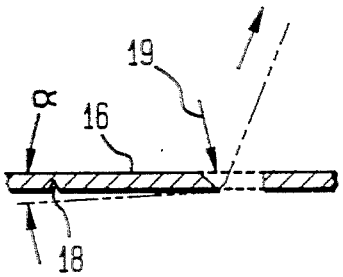

FIG. 1*a* illustrates a modified curling blade in which a notch 18 is incorporated as shown to impart some flexibility to the blade in the direction shown by arrow 19. Such an arrangement may give an enhanced curling effect. The curling blade could alternatively be of thinner section to import the desired flexibility. A flexible curling blade also permits the approach angle $\alpha$ to be changed, by pressing down, and has the further advantage that the user may increase the ribbon drag force by pressing the blade against the guide 14.

Figure 3:
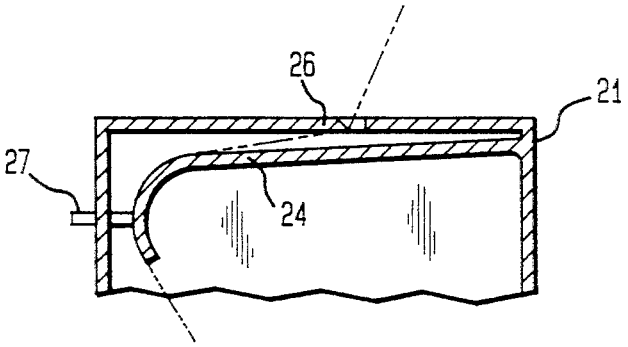
FIG. 3 is a partial transverse section corresponding to FIG. 1 and showing an alternative embodiment of the invention.
Figure 4:
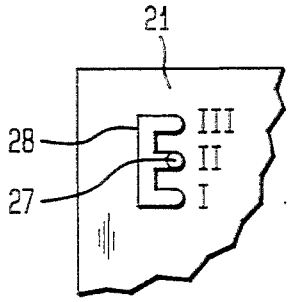
FIG. 4 is a partial end view of the dispenser of FIG. 3.

FIG. 3 illustrates an arrangement in which the guide 24 is flexible and has a protrusion 27 passing through a shaped aperture 28 in the side of the dispenser 21. The aperture 28 is illustrated in FIG. 4 and comprises three slots into one of which the protrusion 27 is spring loaded by the resilience of the guide. The position of the protrusion, and hence of the guide, determines the approach angle of the ribbon to the curling blade 26, and thus the curling effect of the blade for a given departure angle of the ribbon. In other respects the dispenser may be of the kind described with reference to FIGS. 1 and 2.

FIGS. 1–4 illustrate dispensers which may be sized to suit hand-held use or bench mounted use. The embodiment of FIG. 5 illustrates an arrangement small enough for hand-held use and comprises an 'egg' of ribbon contained in a shaped holder 33 formed integrally with the dispenser 31. A guide 34 is constituted by a return edge of the dispenser, and the blade 36 comprises the upper edge of one dispenser end wall. Ribbon curl is determined by the approach angle of the ribbon to the blade and, to a certain extent, by the exit angle.

FIGS. 5*a*–5*j* show various modified ribbon guide arrangements suitable for use with the embodiment of FIG. 5; many of these arrangements are adaptable to other embodiments shown herein.

Figure 5A:
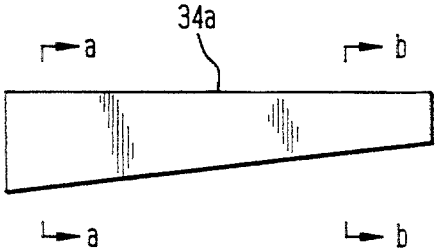
Figure 5B:
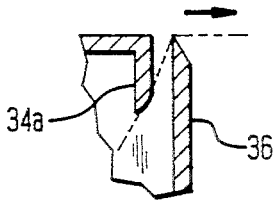
Figure 5C:
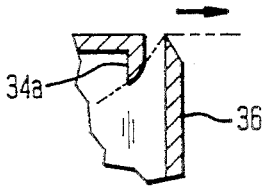

FIG. 5*a* is an elevation of an alternative guide 34*a;* the lower edge of the guide is at an angle to the blade 36 and, as illustrated in FIGS. 5*b* and 5*c,* the approach angle of the ribbon may be changed depending on the lateral exit position of the ribbon.

Figure 5D:
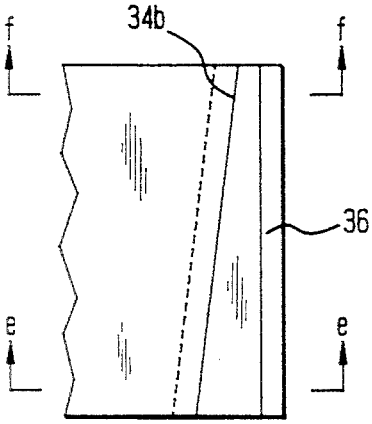
Figure 5E:
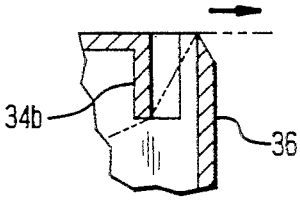
Figure 5F:
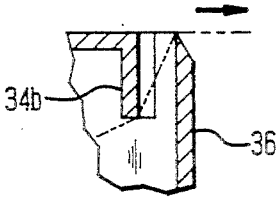

FIG. 5*d* is a plan view of the top of the dispenser showing an angled guide 34*b* of constant depth. Again the ribbon approach angle depends on the lateral exit position of the ribbon, as illustrated in FIGS. 5*e* and 5*f.*

Figure 5G:
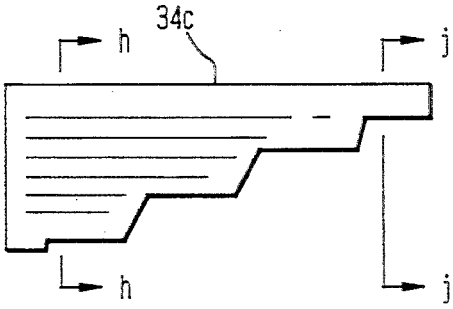
Figure 5H:
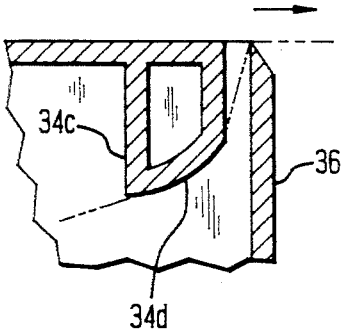
Figure 5J:
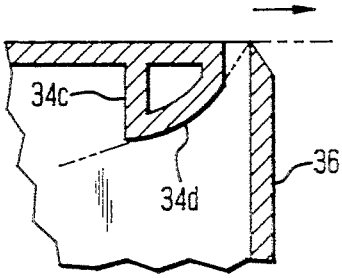

FIG. 5*g* is an elevation of a stepped guide 34*c* having a drag face 34*d* on the lower edge thereof; four distinct ribbon exit positions are provided, each with a different approach angle.

Clearly the features disclosed in FIGS. 5*a*–5*j;* may be combined in any way to achieve a desired effect, perhaps with a variable drag force depending on the approach angle.

As an alternative, or in addition, the relative angle and shape of the curling blade 36 could be changed with respect to the guide 34.

The embodiment of FIGS. 6 and 7 includes a movable guide which comprises a thumb operated slide 47 guided and retained in a slot 48 formed in one wall of the dispenser 41. The slide 47 has a depending guide 44 as illustrated, movement of the slide back and forth altering the approach angle of the ribbon with respect to the curling blade 46. In the illustrated arrangement the dispenser is also provided with a ribbon exit guide constituted by upstanding walls 49; the tolerance of exit angle is determined by the distance between walls 49 and their height. The degree of ribbon curl depends on the position of the slide 47 and hence the position of the guide 44. In an actual embodiment the slide may move only about 1 mm between each of the positions I, II and III to effect a different curling effect.

The slide may be a friction fit in the slot 48 or may be retained in any desired position by means of, for example, an integral detent of the slide and a series of protrusions at the edge of the slot.

The embodiment of FIGS. 8 and 9 includes a fixed guide 64 and the usual curling blade 66 formed in one wall of the dispenser 61.

A shaft 67 journalled in the blade wall of the dispenser has a hand wheel 68 at the outer end and a cam 69 at the inner end and spaced from the inner wall of the dispenser by a shoulder 71.

Rotation of the wheel 68 causes rotation of the cam 69 and thereby changes the effective cam radius as illustrated by FIG. 9. A change in cam radius causes the approach angle of the ribbon to change, thus giving different curling effects. The cam may include radially upstanding protrusions to guide the ribbon to the exit. At one position the radius of the cam is sufficiently small to permit unobstructed passage of the ribbon through the dispenser opening 65; this feature allows uncurled ribbon to be drawn from the dispenser.

An alternative cam wheel 69*a* is shown in FIGS. 10–12. The wheel 69*a* is circular but has an edge of variable thickness as illustrated in the axial sections of FIGS. 11 and 12. The variable thickness edges 72*a*–72*d* serve both to change the ribbon approach angle, and to impose different drag forces on the ribbon.

FIGS. 13 and 14 show yet another variation in which a wheel 69*b* journalled in the dispenser wall has peripheral projections 73*a*–73*d* upstanding therefrom. The projections alter the ribbon approach angle and may be shaped to impose a suitable drag force. More or less projections may be provided.

Clearly any or all of the optional features described above may be incorporated in a ribbon dispenser. These features include the drag surface 14*a;* the flexible curling blade of FIG. 1*a;* the adjustable guide 27; the slidable guide 47; the exit aperture guide 49; and the rotary guide arrangement of FIGS. 8 and 9.

The ribbon supply source could be from any conveniently mounted reel or ball and need not be in the dispenser where the curling arrangement is bench mounted. The ribbon drag could be provided by a friction device acting anywhere on the ribbon or on the ribbon reel or ball, provided always that the drag on one surface of the ribbon is insufficient to cause curling otherwise than at the curling blade; drag means may be provided which act equally on both surfaces of the ribbon.

The dispenser could include an integral cutter to enable ribbon to be cut at a convenient length, and may further include splitting hooks for splitting a ribbon length into strands.

The curling blade may be constituted by the material of the dispenser or may alternatively be an attachment, for example a metal blade pushed onto or into a portion of the ribbon exit aperture.

The precise arrangement and dimensions of the device may be chosen to suit particular requirements of use; of the embodiments shown in the accompanying drawings are for illustration only.

I claim:

1. A ribbon curling device to facilitate the curling of a length of decorative ribbon comprising:

a housing having an interior for storing said having an interior for storing said ribbon;

an aperture in said housing providing an opening for withdrawing said ribbon;

a curling edge provided on an edge of said housing adjacent said aperture; and a guide wall for guiding said ribbon to said curling edge, said guide wall being coextensive and substantially parallel with said curling edge and at least a portion of said housing adjacent said curling edge thereby forming a guide channel to maintain a curl-imparting approach angle of said ribbon within said channel to facilitate the curling of said ribbon as said ribbon is drawn through said channel and over said curling edge.

2. A ribbon curling device as claimed in claim 1, wherein said curling edge is provided immediately adjacent to said exit aperture.

3. A ribbon curling device as claimed in claim 1, wherein said guide wall comprises a guide edge having a length whose distance from said curling edge varies along the length of said guide edge to provide varying curl-imparting approach angles of said ribbon to vary the amount of curl to said ribbon.

4. A ribbon curling device as claimed in claim 3, wherein said guide edge is formed with steps along said length to provide a plurality of predetermined guide positions at each of said steps, said steps corresponding to different curl-imparting approach angles of said ribbon to vary the amount of curl to said ribbon when said ribbon is drawn from each said guide position.

5. A ribbon curling device as claimed in claim 1, wherein said guide wall and said curling edge are movable relative to one another to thereby vary said curl-imparting approach angle of said ribbon to impart a different amount of curl to said ribbon based on the approach angle of said ribbon.

6. A ribbon curling device as claimed in claim 5, wherein said curling edge is fixed relative to said housing and said guide wall is movable relative to said housing.

7. A ribbon curling device as claimed in claim 5, wherein said guide wall is slidably displaceable along said housing to thereby vary the approach angle of said ribbon.

8. A ribbon curling device as claimed in claim 1, wherein said guide wall comprises a guide cam rotatable within said housing, said guide cam comprising a plurality of guide faces each for imparting a different approach angle of said ribbon to vary the amount of curl to said ribbon.

9. A ribbon curling device as claimed in claim 1, wherein said guide wall comprises an arcuate guide member, including drag wall for imparting a frictional drag to said ribbon as said ribbon is drawn along said guide means.

10. A ribbon curling device as claimed in claim 1, wherein a portion of said housing adjacent said curling edge comprises flexure means for imparting a predetermined degree of flexibility to said housing adjacent said curling edge.

11. A ribbon curling device as claimed in claim 10, wherein said flexure means comprises a notch in said housing.

* * * * *

UNITED STATES PATENT AND TRADEMARK OFFICE

CERTIFICATE OF CORRECTION

PATENT NO. : 5,407,417
DATED : 4/18/95
INVENTOR(S) : Fredric Goldstein

It is certified that error appears in the above-indentified patent and that said Letters Patent is hereby corrected as shown below:

Column 2, line 12, "5g" should read --5j--.

Column 2, line 43, "blade" should read --blade 16.--.

Column 5, lines 1 and 2 delete "said having an interior for storing".

Column 5, line 18, delete "exit".

Column 6, line 22, "drag wall" should read --drag means--.

Column 6, line 24, "means" should read --wall--.

Signed and Sealed this

First Day of August, 1995

Bruce Lehman

*Attest:*

BRUCE LEHMAN

*Attesting Officer*

*Commissioner of Patents and Trademarks*